United States Patent [19]

Jürgenhake et al.

[11] Patent Number: 4,896,419

[45] Date of Patent: Jan. 30, 1990

[54] APPARATUS AND PROCESS FOR FASTENING CONTACT PIECES TO ELECTRICAL LEADS

[75] Inventors: Bernard Jürgenhake, Im Brok 45, 4782 Erwitte-Völlinghausen, Fed. Rep. of Germany; Bruno Scholz, Soest; Peter Ettl, Kinding, both of Fed. Rep. of Germany

[73] Assignee: Bernhard Jürgenhake, Erwitte-Völlinghausen, Fed. Rep. of Germany

[21] Appl. No.: 322,846

[22] Filed: Mar. 14, 1989

[30] Foreign Application Priority Data

Mar. 17, 1988 [DE] Fed. Rep. of Germany ..... 3808986
Mar. 17, 1988 [DE] Fed. Rep. of Germany ... 8803655[U]

[51] Int. Cl.[4] ..... H01R 43/04

[52] U.S. Cl. ..... 29/861; 29/748; 29/759; 29/566.2

[58] Field of Search ..... 29/861-863, 29/753, 754, 759, 566.2, 33 M

[56] References Cited

U.S. PATENT DOCUMENTS 3,668,764 6/1972 Randar ..... 29/753
3,747,190 7/1973 Erlichman et al. ..... 29/753
4,051,594 10/1977 Kindig ..... 29/753
4,114,253 9/1978 Loomis et al. ..... 29/753
4,307,504 12/1981 Davis et al. ..... 29/753
4,426,772 1/1984 Collier et al. ..... 29/863

FOREIGN PATENT DOCUMENTS 88053385 7/1988 Fed. Rep. of Germany .

*Primary Examiner*—P. W. Echols
*Attorney, Agent, or Firm*—Griffin, Branigan & Butler

[57] ABSTRACT

An apparatus for fastening contact pieces from a band of series connected contact pieces to leads basically includes a base frame having guiding and transporting elements for the contact pieces as well as crimping anvils and a plunger on which a crimper is arranged and which activates the transporting elements. The transporting elements include a finger which moves perpendicular to a transporting forward direction for engaging the contact pieces and then moves in the forward transporting direction. The finger, in cross sectional shape and size, fits into an opening in the contact pieces such that it is immediately near edges defining the opening in the transporting forward and opposite directions. In addition, a holding element drive preventer engages the contact pieces. Leads are centered relative to crimping claws of the contact pieces by two jaws in the form of simple levers mounted on the base frame and are spring biased to spread from one another but are urged together by downward movement of the plunger.

34 Claims, 10 Drawing Sheets

APPARATUS AND PROCESS FOR FASTENING CONTACT PIECES TO ELECTRICAL LEADS

BACKGROUND OF THE INVENTION

This invention relates generally to processes and apparatus for crimping contact pieces to electrical leads and is more particularly concerned with such apparatus and processes in which leads are inserted between U formed, upwardly-extending, crimping claws of such contact pieces on a base frame while a rammer, with crimpers thereon, interact with the base frame to bend the crimping claws tightly about the leads. The invention concerns such apparatus and processes in which individual contact pieces are connected in series to form a band which is arranged and transported along the base frame in a forward transporting direction with a finger which engages the band and with a holding element which holds the band to prevent rearward, or motion opposite to the forward transport direction, transport thereof.

In well known processes the moving of electrical leads between upwardly extending crimping claws of contact pieces is difficult because arrangements of the leads to the upwardly extending crimping claws of the contact pieces is not sufficiently exact. The contact pieces, with their U-formed upwardly extending crimping claws, are shoved onto ends of leads without the lead ends being exactly positioned relative to the crimping claws. Because of this, individual strands of stranded wire forming lead ends sometimes strike the contact pieces when they are shoved therein so that they are not gripped by the crimping claws when they are bent. It is therefore a purpose of this invention to improve this prior art process such that lead ends, which are to be crimped to contact pieces, are more exactly arranged relative to the upwardly extending crimping claws and, in addition, are not moved between the claws, end first.

Also, by well known apparatus of the art of this invention a band of series connected contact pieces is transported in the forward direction by a lever-like finger whose angled free end is pressed by means of a spring on the band of series connected contact pieces. When the finger is transported in the forward direction, the angled, or bent, free end engages an edge of the contact pieces and shoves these in the forward transporting direction toward a crimping, or striking, stamp. Because the connection between the transporting finger and the contact pieces is only keyed to one side, and because the shoving of the finger is accomplished with great acceleration, a brake must be provided to prevent the contact pieces from being thrown beyond a desired position. This brake is often a plate pressed against the contact pieces by spring force from above. Because of the large acceleration force, a pressing force of the braking plate must be great and with pressure susceptible contact pieces there is often the danger that this force will deform the contact pieces. The pressing force of the braking plate must also be great because when the finger travels rearwardly, its backside is pulled, and lifted across, the contact pieces in order to grip the next contact piece. This opposite driving against an edge to lift the finger is accomplished at a high velocity which introduces a rearward shoving force which must be braked. Therefore, it is an object of this invention to provide a transporting arrangement that catches the momentum of contact pieces at the end of a transporting stroke and in which the transporting, or shoving finger, when traveling rearwardly, produces no rearward shoving force on the contact pieces.

SUMMARY

According to principles of this invention, an end portion of a lead is brought above the crimping claws in a lying position by the apparatus, is centered by two closing jaws and driven downwardly by a plunger between both arms of the crimping claws and is crimped herein by a crimping stamp.

The transport apparatus includes a finger which moves in a direction perpendicular to a forward transporting direction to move into an opening of a contact piece and out of the opening of the contact piece before it respectively moves in the transporting direction and in a direction opposite to the transporting direction, the finger having a shape and size, in cross section, such that it fits into the opening of the contact piece to be immediately next to, or in contact with, portions of the edge of the opening in the contact piece in the edge portion lying in both the transporting direction and the direction opposite the transporting direction. With this arrangement, the braking requirements of a holding element are reduced such that a hanging contact piece band is not pulled out of the apparatus by its own weight on an input side of the apparatus.

In one arrangement of the invention the holding element is a second finger which also moves perpendicular to the transporting direction opposite to movement of the first finger to grip the contact pieces but which does not move in the transporting or opposite directions. With this arrangement, a braking pressing force on the contact pieces is avoided.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE PREFERRED EMBODIMENT

Figure 1:
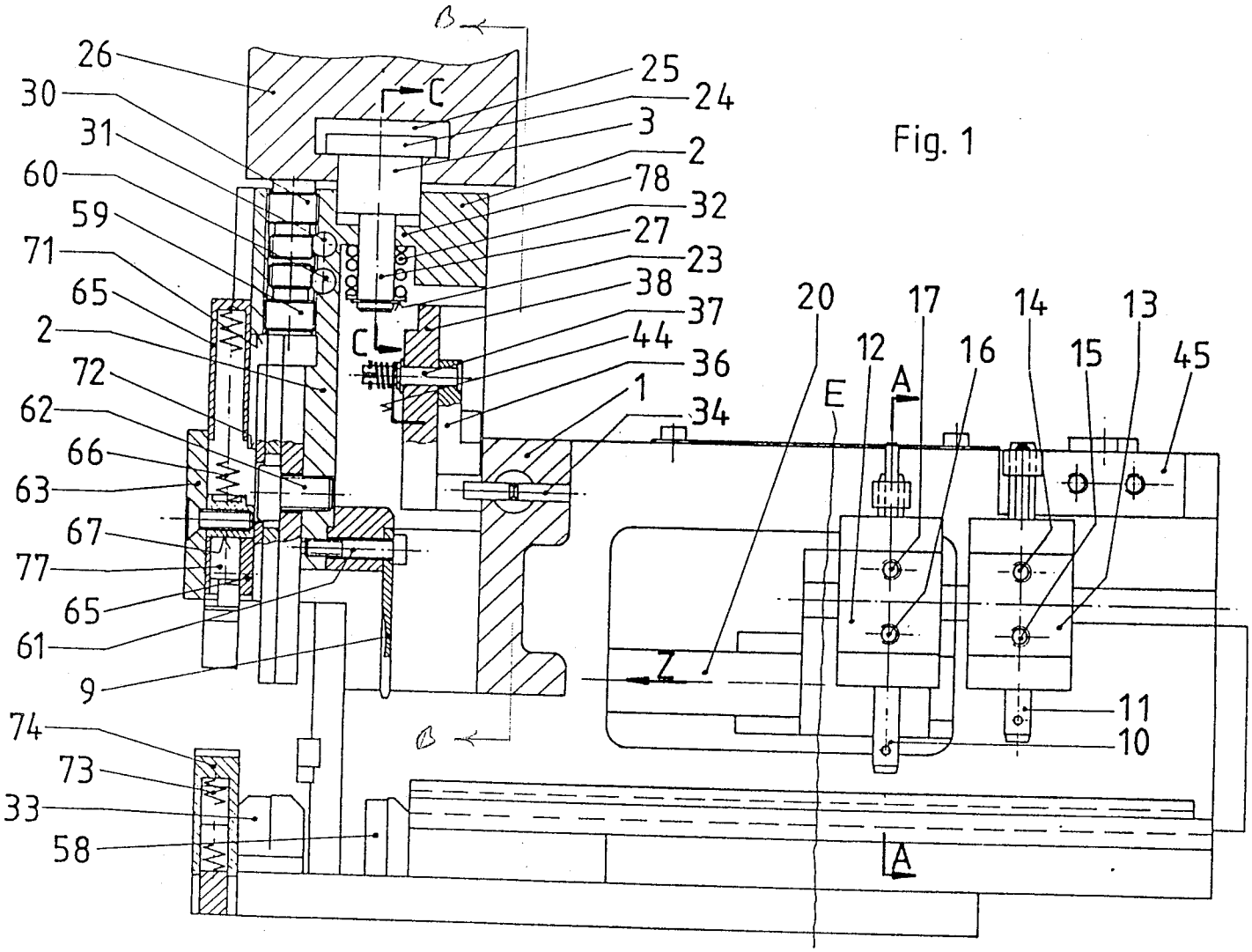
FIG. 1 is a side view of an apparatus of this invention with a partial cross section taken through the middle of a plunger thereof.
Figure 2:
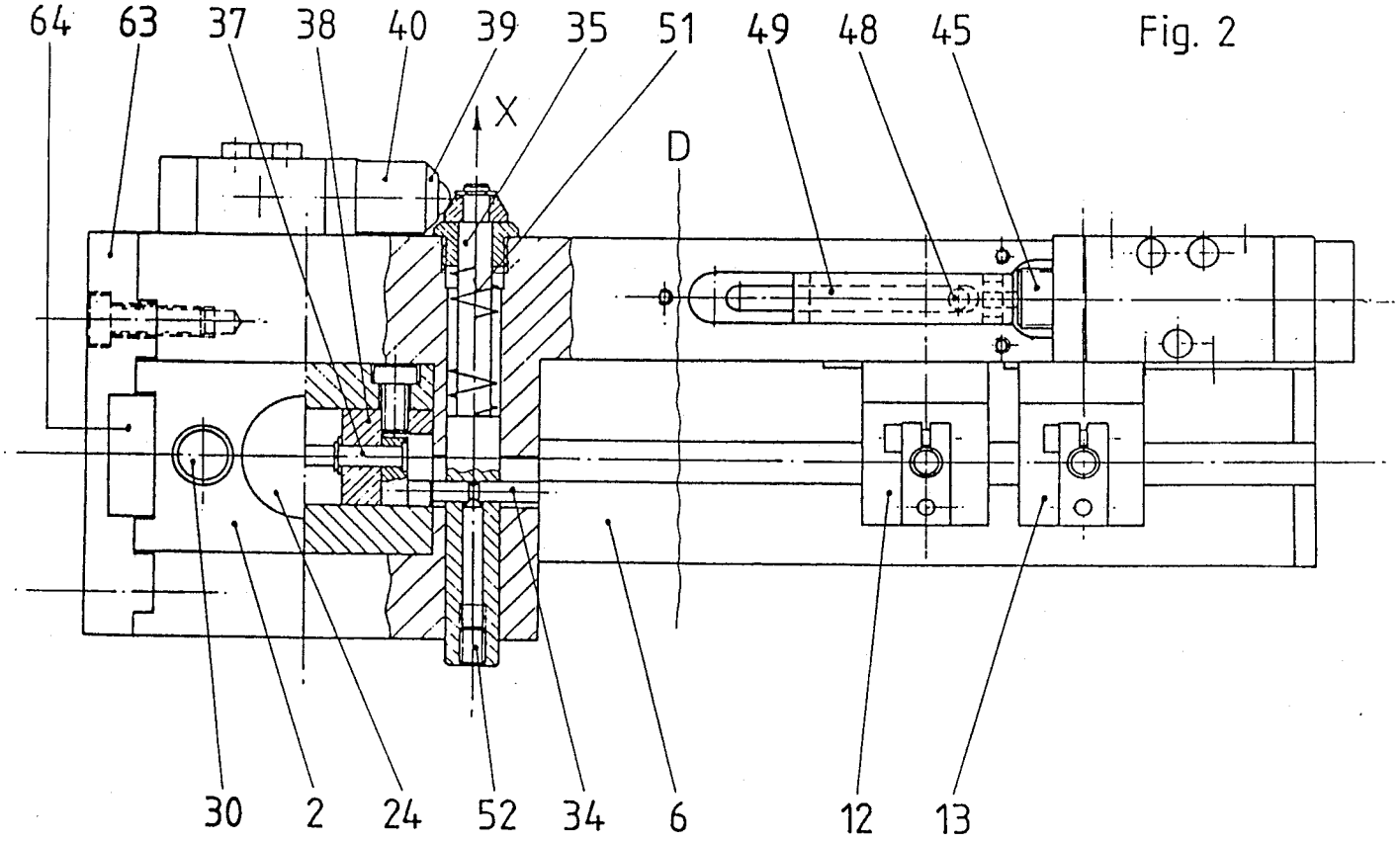
FIG. 2 is a top view of the apparatus of FIG. 1, partially cutaway.
Figure 3:
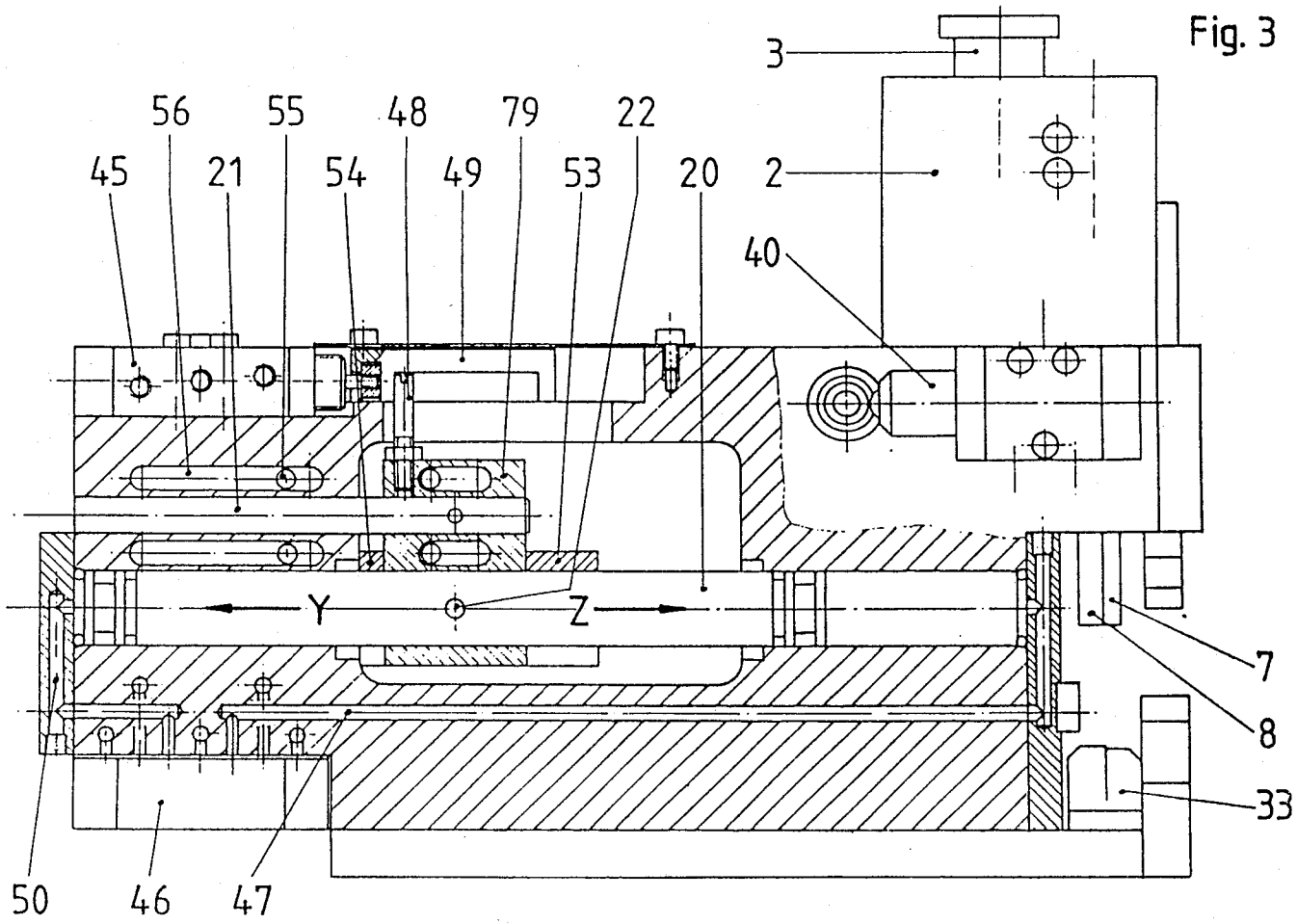
FIG. 3 is a side view of the apparatus of FIG. 1, taken from the other side, with the apparatus being partially cutaway in length along a vertical middle plane through a lateral piston rod.
Figure 4:
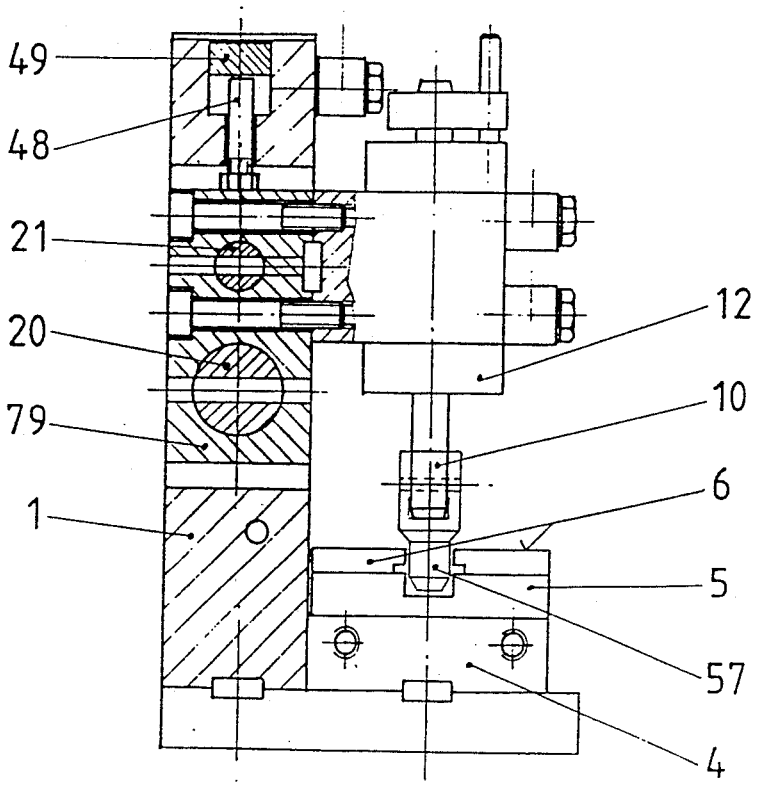
FIG. 4 is a cross section taken on line A—A in FIG. 1.
Figure 5:
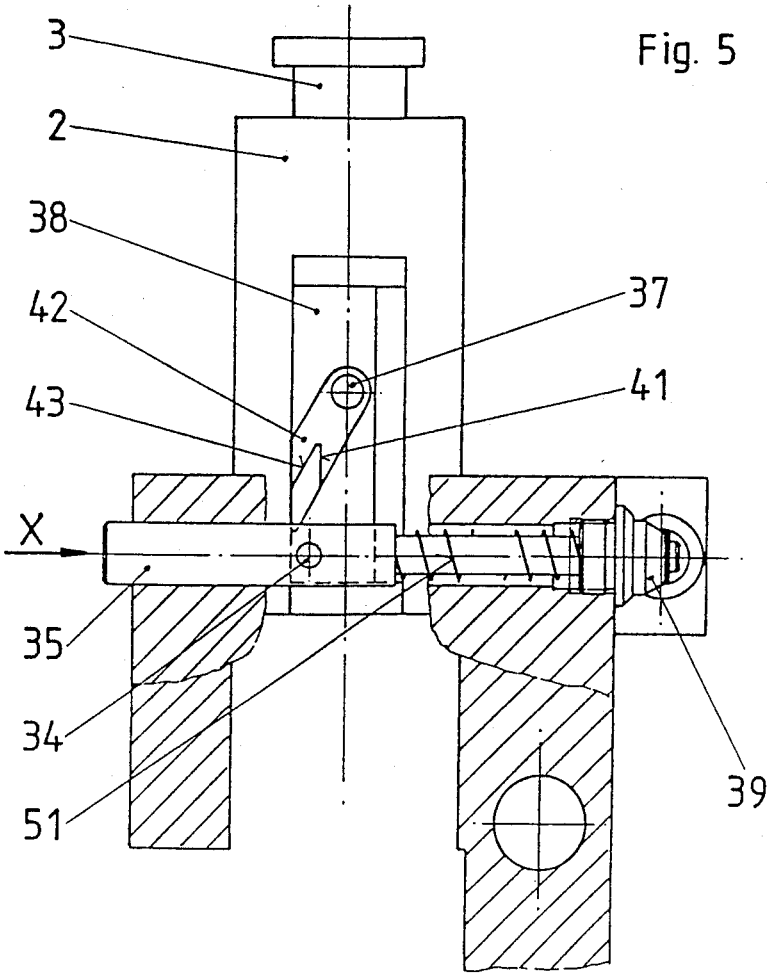
FIG. 5 is a cross section taken on line B—B in FIG. 1.
Figure 6:
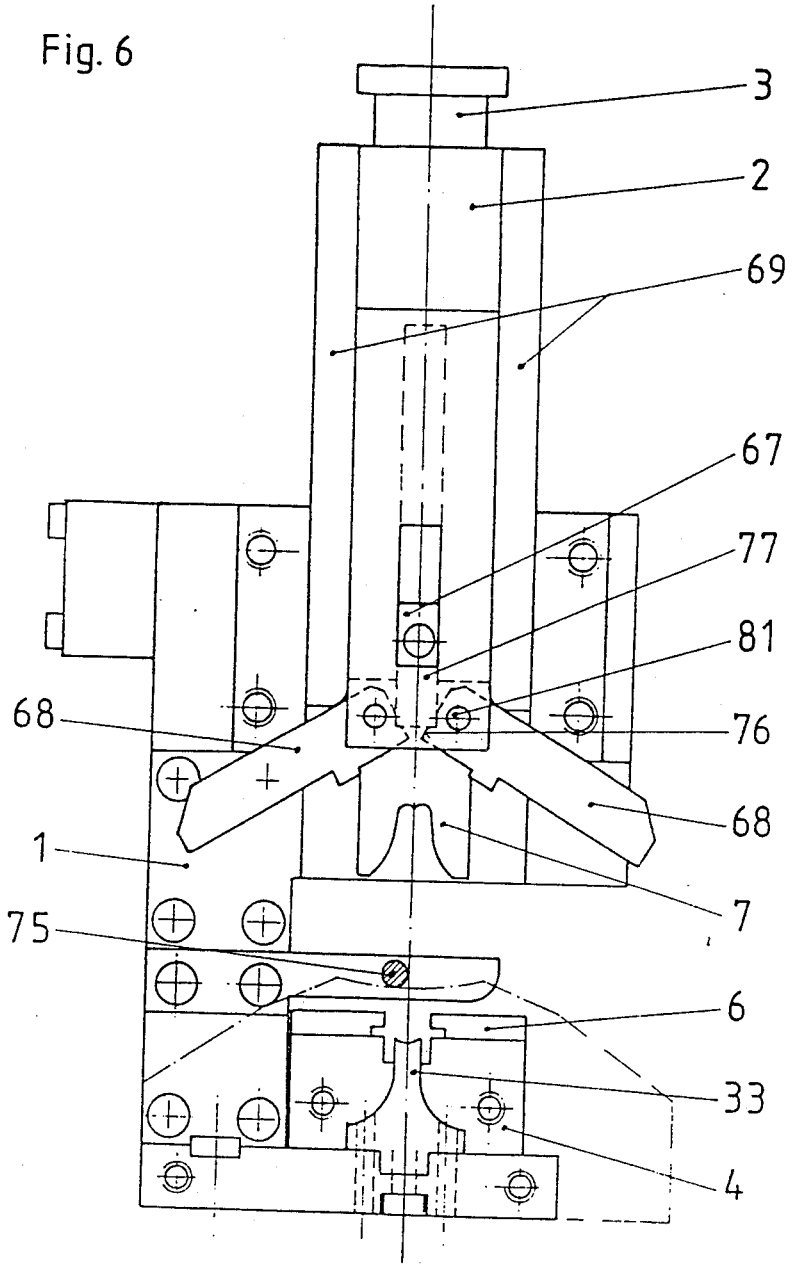
FIG. 6 is a front view of the apparatus of FIG. 1 showing an upwardly driven plunger with parts being removed therefrom for clarity.
Figure 7:
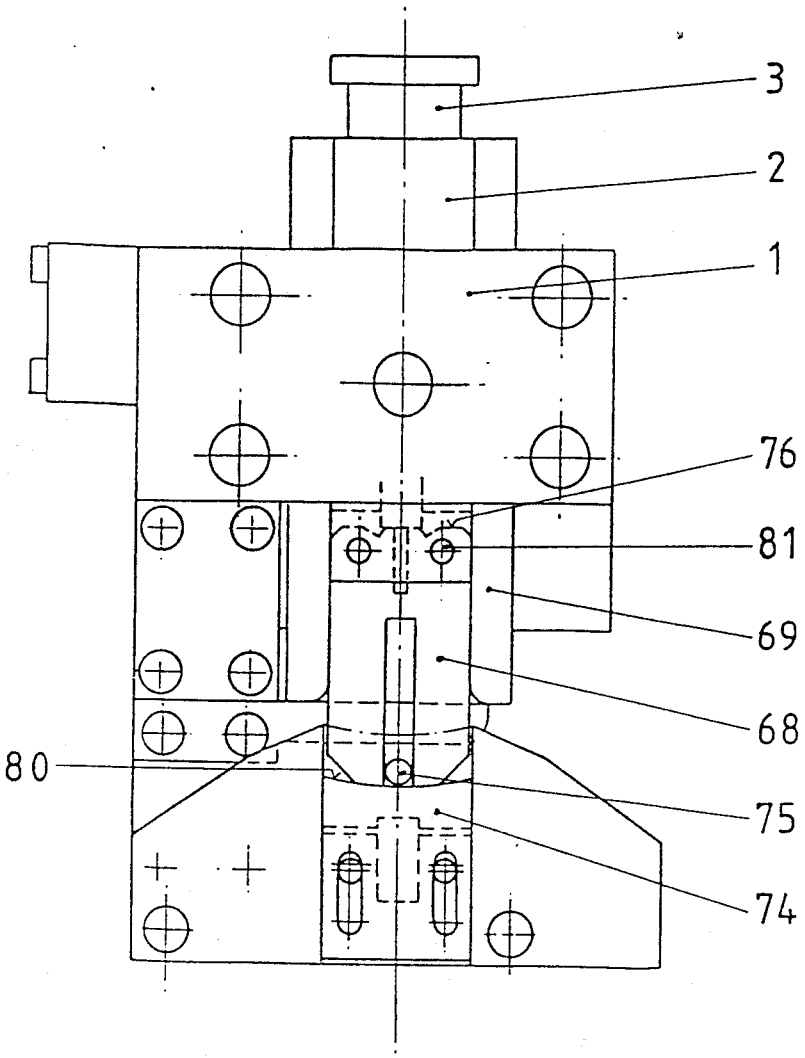
FIG. 7 is a front view of the apparatus of FIG. 1 with the plunger thereof being driven downwardly.
Figure 8:
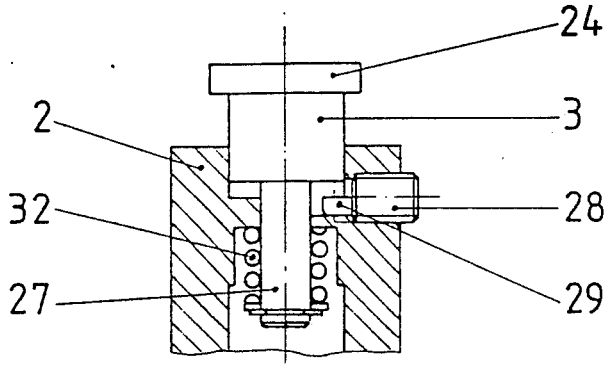
FIG. 8 is a partial cross section of the plunger taken on line C—C in FIG. 1.
Figure 9:
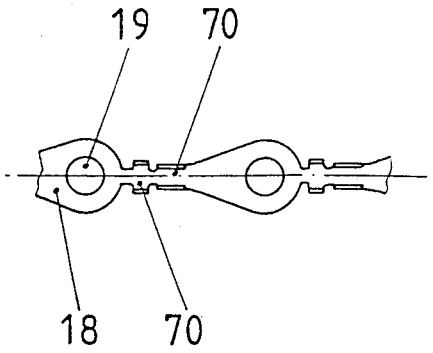
FIG. 9 is a segmented top view of a band of series connected contact pieces with which the apparatus of this invention is used.

A base frame 1 of the apparatus of this invention is mounted on a press table with a supporting plug 3 of its plunger 2 suspended from a rammer 26. A guide plate 5, mounted on a floor plate 4 of the base frame 1 has guiding ledges 6 affixed thereon between which a band of series connected contact pieces 18 to be attached to lead ends are shoved forwardly, step wise, toward an insulation crimper 7 and a wire crimper 8 as well as toward a separating knife 9. The forward shoving is accomplished through a first finger 10 which is pneumatically driven downwardly through an opening 19 of a to-be-attached contact piece 18, is then driven forwardly in a transporting direction toward the crimpers 7 and 8, is raised, and finally is driven back in a direction opposite the forward transporting direction. While the first finger 10 is being driven upwardly, a second, laterally-nonmovable finger, 11 is driven pneumatically downwardly to engage another contact piece 18 and thereby hold the band of series connected contact pieces in its position. When the first finger 10 is driven into the next contact piece 18 the second finger 11 releases its contact piece 18 and is driven again upwardly. Thus, the first and second contact-piece-engaging fingers 10 and 11 are driven axially opposite to one another.

The axial driving of the first and second fingers 10 and 11 is accomplished with respective cylinders 12 and 13 which are energized pneumatically by air pressure. The air pressure connections in the appropriate cylinders 12 and 13 are represented in FIG. 1 by reference numerals 14, 15, 16, and 17. These connections are interconnected via a cross connection such that connection 14 is interconnected with connection 16 and connection 15 is interconnected with connection 17.

The shoving, or transporting, of contact pieces 18 in the forward direction toward the crimpers 7 and 8 is accomplished by means of the first finger 10. In this regard, the cylinder 12 is laterally driven by a piston rod 20. The cylinder 12 is attached to the piston rod 20 via an intermediate piece 79 and a pin 22. To ensure that the cylinder 12 does not rotate about the axis of the piston rod 20, the intermediate piece 79 is affixed to a shaft 21 which slidingly engages the base frame 1.

The plunger 2, which carries the crimpers 7 and 8 and the separating knife 9, rides in a track of the base frame 1. A coupling of the plunger with the rammer 26 is accomplished by the supporting plug 3. The supporting plug 3 is formed with two steps therealong so as to have a head portion, which is shoved in a T-formed slot 25 of the rammer 26, and a finger-like free end 27 which extends through a head plate 78 of the plunger 2. A compression spring 32 is mounted on the finger-like free end of the supporting plug 3 and prestressed thereon in a compressed condition by a spring ring clip 23. A screw 28 is mounted laterally in the plunger 2 with an eccentrically arranged pin 29 positioned under a second step of the supporting plug 3 such that turning the screw 28 can lift the supporting plug 3 against the spring 32. Thus, easy adjustment of the supporting plug 3 within the rammer 26 is possible. To change the lift position of the plunger 2, in order to change the deepest driven position of the crimpers 7 and 8 for example, a threaded bolt 30 is mounted in the plunger 2 from the top or head side which can be rotated by means of a worm 31 so that its height can be adjusted. Should, for example, the plunger 2 be driven deeper into the base frame 1 in order to drive the crimpers 7 and 8 deeper, the threaded bolt 30 is screwed out of the top of the plunger 2 and thereby produces a space between the plunger 2 and the rammer 26. The prestressed spring 32 mounted on the supporting plug has the purpose of maintaining the plunger 2 tightly against the rammer 26. This is particularly important because when adjusting the apparatus the rammer 26 is driven downwardly without a contact piece 18 in the apparatus. Without the compression spring 32 the crimpers 7 and 8 would come down hard on a crimper anvil 33 and could cause damage.

The axial drive of the first and second fingers 10 and 11 and the forward travel of the cylinder 12 in the axial direction of the piston rod 20 is carried out as follows: when the rammer 26 is driven downwardly a lateral pin 34 of an axially displaceable mounted pin 35 glides along on an angled surface 36 of a block 38 which is mounted on one side at axis 37 and engages the plunger 2 to thereby shove the axially displaceable pin in the direction X. This axially displaceable pin 35 activates with its head 39 a valve 40. If the plunger 2 is driven further downwardly, the lateral pin 34 glides along a vertical surface 41 and moves eventually against the force of the spring 51 backwardly into a trap 42. With upward movement, the lateral pin 34 glides across angled surface 43 and rotates the block 38 against the force of a spiral spring 44.

In a rest position, the first finger 10 finds itself in its deepest, or down, position immediately adjacent the second finger 11. Through activation of the valve 40, air pressure is provided to a 5/2-way, pneumatically controlled, slide valve 46. With this, air pressure is provided to the piston rod 20 which is thereby driven in the direction Z and the first finger 10, which is engaging a contact piece 18, is shoved forwardly in the direction of the crimping apparatus. At its end position, a control pin 48 strikes a slide 49 and therewith activates a control valve 45 through which air pressure is given to the cylinders 12 and 13 via air connections 14 and 16. Because of this, the second finger 11 is driven downwardly into an opening 19 of a contact piece 18 while the first finger 10 is pulled out of a contact piece 18 and is moved toward its upper position. By means of a throttle, or similar delaying agency, pressure is provided over a control line to the slide valve 46 which is thereby switched so that the piston rod 20 receives pressure over a channel 47 and is driven in the Y direction. At the end position of the cylinder 12 its control pin 48, switches the control valve 45. With this, air pressure is given to the air connectors 15 and 17 of the cylinders 12 and 13 through which the second finger 11 is pulled out of a contact piece 18 and driven upwardly while the first finger 10 is driven downwardly into an opening 19 of a contact piece 18. With this, a transport cycle is completed. A new cycle is started by the next pressure impulse of the valve 40.

When setting up the apparatus, if it is desired to instigate forward driving of the band of series connected contact pieces without the plunger 2 moving downwardly, the axially displaceable pin 35 can be moved by hand to make initial contact with the valve 40. To do this, a force is employed against an opposite end of the axially displaceable mounted pin opposite from the valve which moves the axially displaceable mounted pin 35 against the force of the spring 51. The lateral pin 34 is affixed by means of a threaded screw 52.

The stroke position and stroke travel of the cylinder 12 is limited by spacers 53 and 54. The cylinder 13 is screwed onto the base frame 1 by means of a headed screw 55. This headed screw 55 can be moved in a slit 56 so that a position of the cylinder 13 can be controlled. A shoe 57 is slid onto the end of each of the first and second finger 10 and 11 which has portions which can be easily inserted into the respective sizes and shapes of the openings 19 of the contact pieces 18.

Figure 10:
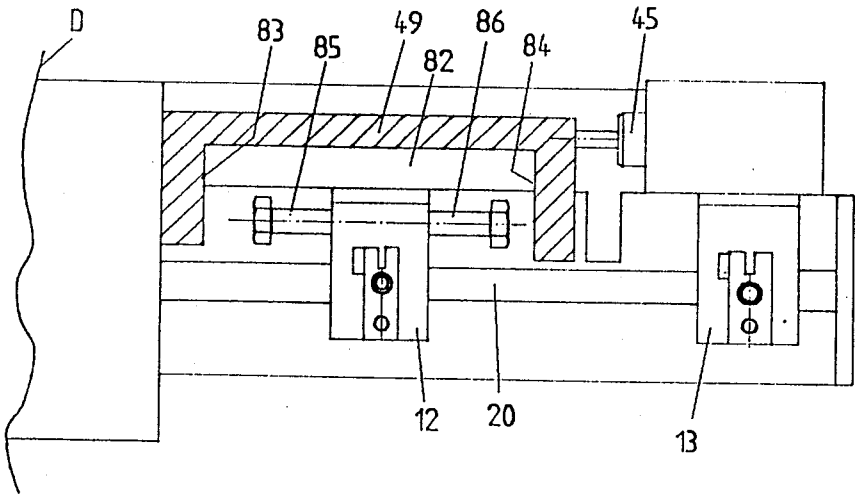
FIG. 10 is an alternate embodiment of a valve control to the right of the dividing line D of FIG. 2.

FIG. 10 shows an alternate embodiment for controlling the control valve 45. In this alternate embodiment, a slide 49 has an elongated cavity 82 defined by end surfaces 83 and 84. The cylinder 12 of the first finger 10 moves between these end surfaces 83 and 84. Strikers 85 and 86 in the form of bolts which can be adjusted in the Z and Y directions protrude out of opposite sides of the cylinder 12. In this manner, the stroke length as well as the stroke position of the cylinder 12 on the piston rod 20 can be varied. When the cylinder 12 is moved with the piston rod 20 the length-adjustable strikers 85 and 86 strike against the end surfaces 83 and 84 and thereby shove the slide 49 which is coupled to the control valve 45.

Figure 11:
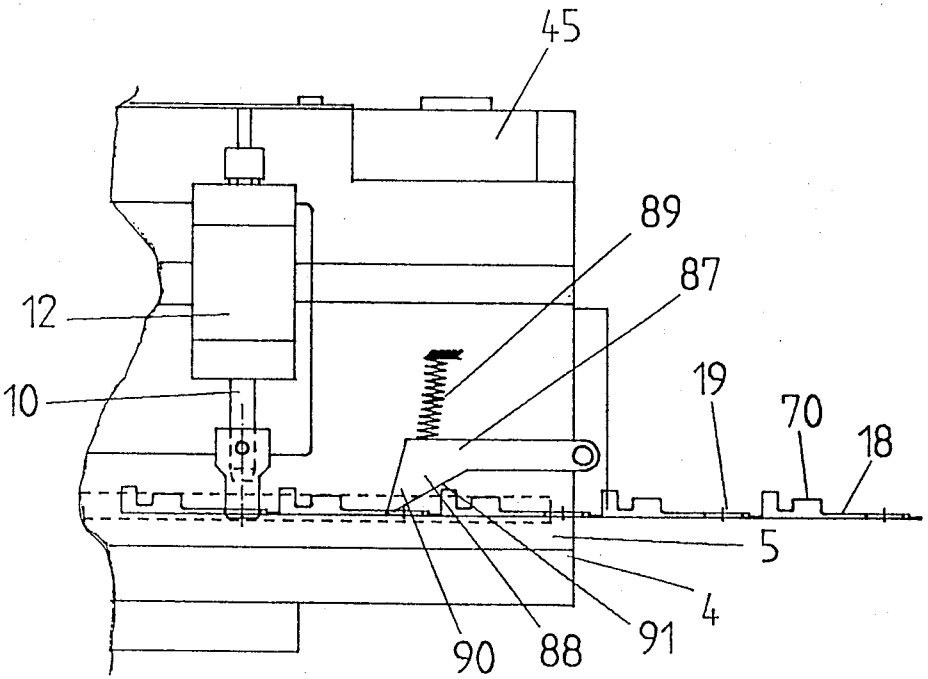
FIG. 11 is an alternate embodiment of the finger-formed holding element shown to the right of the dividing line E in FIG. 1.

In another alternate embodiment which is represented in FIG. 11, the second finger 11 is not pneumatically or hydraulically moved, but rather mechanically. In this embodiment, a holding element forming the finger is constructed as a simple lever 87 which is rotatably mounted on the ground frame 1 with a head end 88 having a nose 90 directed in the working direction of a pressing spring 89. On a side of the nose 90 opposite the forward direction Z there is a ramp 91 which glides over crimping claws 70 of the contact pieces 18 as the contact pieces 18 are moved in the forward direction Z so as to rotate the lever 87 against force of the pressing spring 89 upwardly. After gliding over the crimping claws the lever 87, with its nose 90, falls downwardly behind the crimping claws 70 and thereby ensures that the band of series connected contact pieces is not inadvertently pulled out of the apparatus, for example from weight of a hanging loop developed between the apparatus and a contact piece roll. This reverse travel preventer is particularly uncomplicated in its construction and is reliable in operation.

The separating knife 9, which works with a knife anvil 58, as well as the wire crimper 8 are tightly, and unadjustably, attached to the plunger 2 by means of headed screws 61 and 62. On the other hand, the insulation crimper 7, as opposed to the wire crimper 8, is positioned to be adjustable in its depth. For this purpose, a second threaded bolt 59 is arranged under the threaded bolt 30 which is adjustable by means of a second worm 60. With this the stroke position of the insulation crimper 7 can be adjusted.

A bridge 63 is screwed to the front of the base frame 1 that, together with the plunger 2 defines a channel 64. A slide 65 is set in this channel 64 which presses against a compression spring 66 which engages a supporting piece 67 screwed to the bridge 63 and which can be moved in the direction of the crimper anvil 33. Two rotatable jaws 68 which are spread apart through spring force are mounted on the slide 65 and are caused to rotate together by forked shaped ledges 69 when the plunger 2 moves downwardly. When doing this, the jaws 68 grab a lead 75 that lies on the cylindrically concaved support surface 80 of a lower part 74 and centers it such that it is properly positioned with regard to the crimping claws 70 of a contact piece 18. With further downward movement of the plunger 2, an edge 71 of the plunger 2 strikes an edge 72 of the slide 65 and shoves the slide 65 against the force of the spring 66 downwardly. Thereby the two jaws 68, with the lead held between them, moves further downwardly so that they contact the lower part 74 which is also shoved downwardly against a force of the spring 73. In this manner, the lead 75 is placed between the U or V formed upwardly extending crimping claws 70 of the contact piece 18. With further downward movement of the insulation crimper 7 and wire crimper 8 the upwardly extending crimping claws 70 are bent to such an extent that they tightly surround and grab the uninsulated wire end portion and the insulation sheath of the electrical lead. With upward movement of the plunger 2, edges 76 of the jaw 68, which lie between the axes 81, strike a pushing piece 77 which, in turn, is supported by the supporting piece 67. With this, both jaws 68 are pivoted further apart.

It will appreciated by those of ordinary skill in the art that the electrical lead end portions do not need to slide between the jaws when they are laid between the crimping claws because the axes of the jaws are movable against the force of a spring in the direction of the contact pieces. This movement takes place first when the lead end portions are gripped by the jaws.

It will also be recognized that it is advantageous to have a spring biased lower part to serve as a platform for the lead and against which the closing jaws of the slide ride.

It should be recognized that the arrangement of the jaws on a spring biased slide with edges in the direction of the support plug lying between their pivot axes for contacting the base pushing piece makes possible the spreading of the jaws without a spring arranged exactly in the area of these jaws. Also, it is advantageous for the pushing piece to be rectangularly formed and to place notches on the edges of the jaws which contact the rectangular pushing piece. The edges of the rectangular pushing piece grip in the notches so that coupling between the pushing piece and the jaws is locked.

The rectangularly formed pushing piece and supporting piece form a support piece over which the jaw mounted, spring biased, slide glides. The support piece is screwed onto a bridge which forms a guide on the front of the base frame for the plunger.

It should be understood that in order to vary the separation of the jaws a loose pushing piece is positioned between the support piece and the jaws. This loose pushing piece is easily removed and can be replaced by a pushing piece of another size.

With another advantageous embodiment of the invention an edge of the slide protrudes into a movement area of an edge of the plunger and the space between these edges is larger than the stroke of the plunger necessary for closing the jaws. With such an arrangement, it is ensured that a lead will be first centered by the jaws and will only be laid between the crimping claws after a delay to allow such centering. This provides the further assurance that the jaws, when they close together, do not contact an edge of the lead supporting lower part.

In order to be able to drive the free ends of the jaws as near as possible to the supporting platform of the lower part in order to positively grip the lead, the supporting platform has a concave cylindrical shape whose radius corresponds to that defined by the ends of the rotatable jaws.

It will be further understood that by making the transporting first and second fingers as extensions of pneumatically or hydraulically driven pistons of two piston cylinder systems the arrangement has few driven parts such that the driven parts have small masses. Thus, the transporting arrangement operates with a small expenditure of energy.

In order to keep the control system uncomplicated, it is useful that the pneumatic or hydraulic connections to the cylinder for the forward and rearward transport communicates with a cross connection coupled to corresponding connections of another cylinder.

Also, it will be understood by those of ordinary skill in the art that a first cylinder with a first finger for shoving the contact pieces driven by a pneumatic or hydraulic piston rod makes control of the system for transporting the contact pieces uncomplicated and reliable. Also, the first cylinder, is additionally supported by a pin which slidably engages the base frame. In this manner, the cylinder and its piston are prevented from rotating. It is advantageous that the cylinder is affixed to the pin and that the pin is slidably mounted in a bore of the base frame. The second cylinder of the second finger is screwed to the base frame.

In order to make the size and shape of the finger independent of the size and shape of the opening in the contact piece, a shoe is placed on the free end of the finger. With this arrangement, the apparatus can be used with many different arrangements of contact pieces.

A further particularly advantageous aspect of the invention is that the plunger activates a valve which provides a pressure medium to a control valve which, in turn, drives the pistons of the fingers. The control valve, on the other hand, is controlled by a control pin coupled to the cylinder of the first finger which rides in an elongated cavity, elongated in the transport direction, of a slide. In addition, the control valve is coupled to a further valve which provides a pressurized medium to drive the cylinder of the first finger. Such a control is uncomplicated in construction and because of its uncomplicated structure is reliable and functional. This is particularly true when the pressure medium is pressurized air.

In another particularly advantageous embodiment of the invention the control valve is controlled by strikers extending from opposite sides of the cylinder of the first finger which are adjustable in the transport direction and in the opposite, or return, direction. In this regard, the adjustable strikers protrude in an elongated cavity of a slide and move the slide to activate the control valve by striking against respective end surfaces forming the cavity.

It is particularly advantageous that the control valve is activated by a plunger via a linearly movable pin which can also be moved by hand manipulation. With this arrangement, it is possible, when adjusting transport of the contact pieces, to activate the transport system without the plunger being moved in the base frame. This provides an improved reliability.

In order to protect the pressure medium lines, particularly those which present an obstruction when the apparatus is set up or can be easily damaged, the pressure medium lines between the slide valve and the cylinder of the piston rod are bored at least partially in the base frame. Also, it is advantageous to provide a hollow chamber in the base frame as a storage, or surge tank, for the pressurized medium. In this manner, pressure changes in the pressure line system can be smoothed out.

In another embodiment of the invention, it is advantageous that the holding element is rotatably or movably mounted at an otherwise fixed position and that it has a spring biased finger whose leading end has a ramp on a side thereof facing opposite the forward transporting direction for engaging an edge formed on a contact piece after a successful forward shoving stroke. In this manner, the band of series connected contact pieces is prevented from sliding out of the apparatus when the first finger is traveling in the reverse direction, for example from being pulled out by weight of a contact piece chain hanging from the machine. This embodiment provides an uncomplicated construction and effective mechanism if the finger is constructed as a pivotal simple, or single-arm, lever whose head, or leading end in the biasing direction of the spring, has a nose thereon with ramp on one side and a square edge on the other.

The embodiments of the invention in which an exclusive property or privilege are claimed are defined as follows:

1. A process for crimping a contact piece on an electrical lead in which an end section of an electrical lead extending into a crimping machine is guided between upwardly extending U-formed crimping claws of a contact piece held in a base frame of the crimping machine and is crimped therein by a plunger acting in combination with a crimping base-frame anvil, said process comprising the steps of:

bringing the end section of the electrical lead to a position over the crimping claws;

moving the plunger toward the electrical lead and the crimping claws;

centering and gripping the end section of the electrical lead with two jaws which are enclosed by contact with said plunger and driving the end section of the electrical lead downwardly with the plunger and the closed jaws to position the lead between shanks of the crimping claws;

crimping the crimping claws on the end section of the electrical lead with members mounted on the plunger.

2. The process of claim 1 in which the step of moving the plunger toward the electrical lead and the crimping claws includes the substep of guiding the plunger in a slot of the base frame and in which the closing jaws for carrying out the centering and gripping step are formed of single-armed, or simple, levers mounted on the base frame to be closed by the downwardly traveling plunger.

3. The process of claim 2 in which axes about which both levers rotate are also moved in the direction toward the contact piece against the force of a spring during movement of the plunger.

4. The process of claim 3 in which the levers are respectively mounted at spaced axes on a slide which is mounted on the base frame to be movable against the force of said spring toward the contact piece and further including the substeps of spreading said levers by a spring force and closing said levers by contacting them with two protrusions on the plunger as they move with the plunger for forcing the levers together.

5. The process of claim 4 wherein the base frame includes a lower spring-mounted platform which serves as a support for the lead and including the step of driving the closed levers mounted on the slide at the edge of the plunger thereagainst.

6. The process of claim 5 in which is further included the step of raising the plunger after the lead has been crimped to the contact piece and at the same time raising the slide, with a spring to press edges of those portions of the levers between their axes directed away from the lead against a shoulder on the base frame to thereby positively move the levers toward an open attitude.

7. The process of claim 6 in which the shoulder is rectangularly shaped and those portions of the levers which contact the shoulder, have notches therein.

8. The process of claim 6 wherein said shoulder is formed as a supporting part over which the spring biased slide, with levers thereon, glides, the shoulder being attached to a bridge of a track of the base frame in which the plunger rides.

9. The process according to claim 7 in which a loose pushing piece is mounted between the supporting part and the levers.

10. A process as in claim 2 wherein the step of closing said levers is accomplished by protrusions on the plunger in the form of elongated ledges extending in the direction of plunger travel.

11. The process according to claim 4 in which an edge of the slide extends into the working area of an edge of the plunger, but in which a distance between these two edges is greater than a stroke of the plunger necessary to close the jaws.

12. The process as in claim 2 in which the step of bringing the end section of the electrical lead over the crimping claws includes laying the lead on a supporting platform of a lower part which has a cylindrical, concaved, surface whose radius corresponds to the radius of free ends of the rotatable levers.

13. Apparatus for fastening individual contact pieces from band formed series connected contact pieces to electrical leads comprising:

a base frame for holding the band-formed series connected contact pieces as they are moved along;

a transporting assembly mounted on the base frame including a first finger for engaging the band-formed series connected contact pieces and shoving them in a forwardly direction, step fashion;

a holding means mounted on the base frame for holding the band-formed, series-connected, contact pieces in their forwardly shoved positions;

a plunger on which an impact press is mounted;

the transporting assembly including an activating mechanism coupled to the plunger;

the first finger of said transporting assembly moving into an opening in the contact pieces in a direction perpendicular to the forward direction in which the contact pieces are shoved and thereafter moving in the forward direction, the finger being shaped and sized in cross section to fit into the opening in the contact piece such that it engages a forward edge of the opening of the contact piece.

14. Apparatus as in claim 13 wherein the holding means is a second finger which also moves in a direction perpendicular to the forward direction to engage the contact pieces, but whose movements are synchronized oppositely to such movements of the first finger, said second finger being stationary in directions parallel to the forward direction.

15. Apparatus as in claim 14 wherein the second finger comprises a second piston driven by a cylinder attached to the base frame.

16. An apparatus as in claim 14 wherein the first and second fingers comprise first and second pistons respectively driven by first and second fluid cylinders and wherein fluid connections to said first and second fluid cylinders are reversed for driving said first and second pistons oppositely.

17. Apparatus as in claim 16 wherein the activating mechanism includes an initiating control valve operated by a plunger for providing a flow of fluid pressure to a distribution valve which controls the respective operations of the first and second fluid cylinders of the first and second fingers.

18. Apparatus according to claim 17 wherein a control valve is controlled by a control pin of the first cylinder which rides in a cavity elongated in the forward direction of a slide, the slide contacting an activating mechanism of the control valve.

19. Apparatus as in claim 18 in which the control valve is controlled by adjustable strikers mounted on opposite sides of the first cylinder, the strikers being adjustable in the forward direction and an opposite direction for striking the slide.

20. Apparatus as in claim 18 wherein the control valve is coupled to a further valve which provides pressure medium to a piston rod on which the first cylinder of the first finger is mounted.

21. Apparatus as in claim 20 in which the control valve and the further valve produce a 5/2 way valve system.

22. Apparatus according to claim 20 in which pressure lines for the pressure medium are bored or molded in the base frame.

23. Apparatus according to claim 22 wherein the base frame includes a surge cavity as storage for the pressure medium.

24. Apparatus according to claim 17 in which the initiating control valve is activated by a pin moved along its length by the plunger which can also be hand manipulated.

25. Apparatus as in claim 14 wherein one of the first and second fingers includes a separate shoe at its free end for engaging the contact pieces.

26. Apparatus as in claim 13 wherein one of said first and second fingers includes an extension of a fluid driven piston.

27. An apparatus as in claim 13 wherein the first finger comprises a piston driven by a first fluid cylinder, and wherein is further included a lateral piston rod for driving the first fluid cylinder in the forward direction.

28. Apparatus as in claim 27 wherein is included a guiding means for mounting the first cylinder to the base frame such that linear motion parallel to the forward direction is allowed but rotation of the first fluid cylinder is not allowed.

29. Apparatus as in claim 28 wherein said guiding means includes a guiding rod parallel to the lateral piston rod.

30. Apparatus as in claim 29 wherein the first fluid cylinder is affixed to the guiding rod and the guiding rod is slidable in the base frame.

31. Apparatus as in claim 13 wherein the holding element comprises a spring biased rotatable finger mounted on a fixed member, with a side of the finger facing a direction opposite to the forward direction having a ramp formed surface which rides over a protrusion of a contact piece so that an opposite side can engage and hold the rear end of the contact piece after the contact piece has been moved forwardly.

32. Apparatus according to claim 31 in which the finger is constructed as a rotatable simple lever whose head end has a nose thereon in the direction it is driven by a spring.

33. Apparatus for crimping a contact piece on an electrical lead in which an end section of an electrical lead extending into a crimping machine is guided between upwardly extending U-formed crimping claws of a contact piece held in a base frame of the crimping machine and is crimped therein by a plunger acting in combination with a crimping base-frame anvil, said apparatus comprising:

a transporting assembly mounted on said base frame for moving a contact piece into position for crimping it to a lead;

a plunger including means for driving said plunger toward said electrical lead positioned over said crimping claws of said positioned contact piece;

means for centering and gripping the end section of the electrical lead, said centering and gripping means including two closing jaws for contacting said plunger when said plunger is driven toward said electrical lead to be thereby closed onto the end section of said electrical lead so that said jaws center and grip said end section of said electrical lead to carry it downwardly with said plunger and said closed jaws to position the lead between shanks of the crimping claws;

said plunger including means thereon for crimping the crimping claws onto the end section of said electrical lead.

34. Apparatus as in claim 33 wherein said transporting assembly is for holding band-formed series connected contact pieces as they are moved along, said transporting assembly comprising;

a first finger for engaging the band-formed series connected contact pieces and shoving them in a forwardly direction, step fashion;

a holding means mounted on the base frame for holding the band-formed, series-connected, contact pieces in their forwardly shoved position;

the transporting assembly including an activating mechanism coupled to the plunger;

the first finger of said transporting assembly moving into an opening in the contact pieces in a direction perpendicular to the forward direction in which the contact pieces are shoved and thereafter moving in the forward direction, the finger being shaped and sized in cross section to fit into the opening in the contact piece such that it engages an edge of the contact piece defining the opening in the forward direction.

* * * * *